United States Patent [19]

Moakes

[11] Patent Number: 4,645,177

[45] Date of Patent: Feb. 24, 1987

[54] TUBULAR CONNECTION

[76] Inventor: David P. Moakes, 1 The Commons, Welwyn Garden City, Hertfordshire, England

[21] Appl. No.: 731,228

[22] Filed: May 7, 1985

[30] Foreign Application Priority Data

May 8, 1984 [GB] United Kingdom ..... 8411719

[51] Int. Cl.[4] ..... F16K 51/00; F16L 29/00

[52] U.S. Cl. ..... 251/144; 251/148; 285/178; 285/331; 285/921

[58] Field of Search ..... 285/178, 331, 921, 423; 251/144, 145, 148

[56] References Cited

U.S. PATENT DOCUMENTS 3,472,531 10/1969 Evesque ..... 285/178
3,588,149 6/1971 Demler et al. ..... 285/331
3,997,195 12/1976 Bartholomew ..... 285/331
4,452,425 6/1984 Lucking ..... 251/342

*Primary Examiner*—A. Michael Chambers
*Attorney, Agent, or Firm*—Spencer & Frank

[57] ABSTRACT

A sleeve-like component 1 is adapted to welded to a plastic bag containing a liquid to be dispensed such as wine or beer. The sleeve has an outer tubular part and an inner tubular part defining an annular space adapted to receive one end of a tube mounted on a tap assembly. The tube on the tap assembly has a peripheral rib which engages a recess formed on the outer tube part of the sleeve thus ensuring that a very good seal is provided and also helping to ensure that the tap will not be separated from the sleeve even if subjected to high pressure from the liquid within the bag which may be a carbonated beverage or a fermenting liquid.

6 Claims, 3 Drawing Figures

TUBULAR CONNECTION

BACKGROUND OF THE INVENTION

The present invention relates to a tubular connection, and more particularly the present invention relates to a tubular connection for connecting a dispensing valve to a flexible plastics bag, which may be laminated, adapted to contain a liquid, such as wine or beer, to enable the dispensing to be utilised to dispense the liquid from the container.

It has been proposed to utilise flexible plastic bags, for example bags of laminated plastic film or bags of laminated metalised plastic film, to hold liquids, such as wine, the bags being retained in a suitable container such as a cardboard box or a tube, the bag also being provided with a dispensing valve or tap to facilitate the dispensing of liquids from the bags.

To facilitate the manufacture of the bags and the associated valves it has been proposed to manufacture the bags with a protruding tubular sleeve which communicates with the interior of the bag. It has been proposed previously to slidably insert a tubular part of a valve into the sleeve so that a friction fit is created which retains the valve in position.

It has been found that this construction can lead to problems, especially if there is repeated operation of the dispensing valve, which can increase the possibility of the dispensing valve being separated from the sleeve. Also, it has been found that if a bag of the above-described prior proposed type is utilised with a carbonated beverage or a fermenting liquid, the pressure created within the bag tends to push the dispensing valve out of the sleeve. This problem arises particularly if the containers are shaken, or if they are left to become warm.

SUMMARY OF THE INVENTION

The present invention seeks to provide a connection which can be utilised to connect a dispensing valve to a bag intended to contain a liquid, in which the aforesaid difficulties are overcome or obviated.

According to this invention there is provided a tubular connection, said connection comprising a first element having an inner tubular portion sealingly connected to an outer tubular portion which is substantially coaxial with the inner tubular portion, an annular space being defined between the outer tubular portion and the inner tubular portion, and a further tubular portion to be connected thereto, said further tubular portion being dimensioned to have an end part thereof received within said annular space, one of said tubular portions being provided with an annular rib thereon which is engageable with an annular recess on another of said tubular members when the connector is fully assembled, the rib and recess being in the region of said annular space defined between the inner tubular portion and the outer tubular portion.

Preferably the rib is on the exterior of said further portion and the recess is on the interior of said outer tubular portion.

Conveniently the inner and outer tubular portions are mounted on a collar connected to a plastic bag adapted to contain a liquid.

Advantageously the further tubular portion is connected to a tap.

Preferably the further tubular portion is provided with a projecting flange which is engaged by a snap fastening element provided on the said outer tubular portion.

The invention also relates to a connector as described above forming part of a bag containing a carbonated beverage, the connector supporting a tap mounted on said further tubular portion to enable the beverage to be dispensed.

BRIEF DESCRIPTION OF THE DRAWINGS

In order that the invention may be more readily understood, and so that further features thereof may be appreciated, the invention will now be described by way of example with reference to the accompanying drawings in which.

DESCRIPTION OF THE PREFERRED EMBODIMENTS

Figure 1:
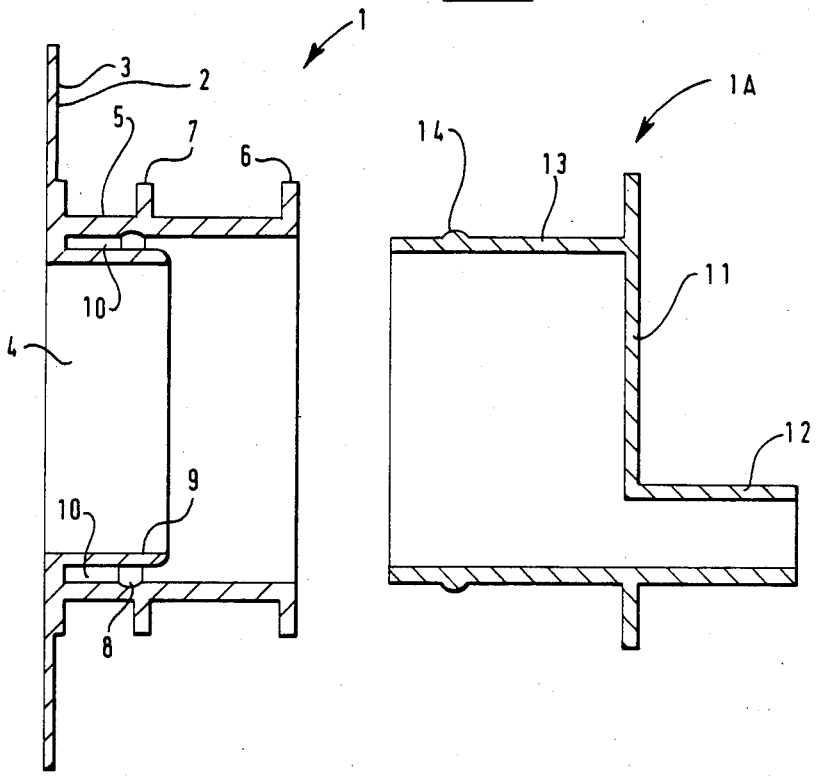
FIG. 1 is an exploded cross sectional view of a connection in accordance with the invention.

A connection in accordance with the invention, as shown in FIG. 1, comprises a sleeve part 1, and a tap part 1*a* which can be connected to the sleeve.

The sleeve part consists of an annular collar 2, the radially outermost part of which, 3 is of reduced thickness. The collar is adapted to be welded or otherwise secured to a flexible plastic bag, such as a bag of laminated plastic film or laminated metalised plastic film. The collar defines a central aperture 4. Extending from the front face of the collar 2, and surrounding the aperture 4, is an outer tubular projection 5. The tubular projection 5 has a radially outwardly expanding flange 6 at the free end thereof, and also a further flange 7, of a size similar to that of the flange 6, at an intermediate position.

An annular recess 8 is provided on the interior of the wall of the tubular projection 5 at a position which is closer to the collar 2 than is the flange 7.

A second tubular projection 9 of lesser diameter than the projection 5 is provided which is located in a position which is nested within the projection 5 so that a narrow annular space 10 is defined between the projection 5 and the projection 9. The projection 9 extends to a position which is further from the collar 2 than the recess 8.

The tab part 1*a* consists of a circular end wall 11 from which projects a relatively small diameter pipe 12 on which is mounted a conventional closure tap 20. The outer wall is provided with a protruding tubular portion 13 provided with a peripheral rib 14 on the end thereof. The tubular portion 13 is in dimension to be inserted within the tubular projection 5, with the rib 14 being received in the recess 8.

Figure 2:
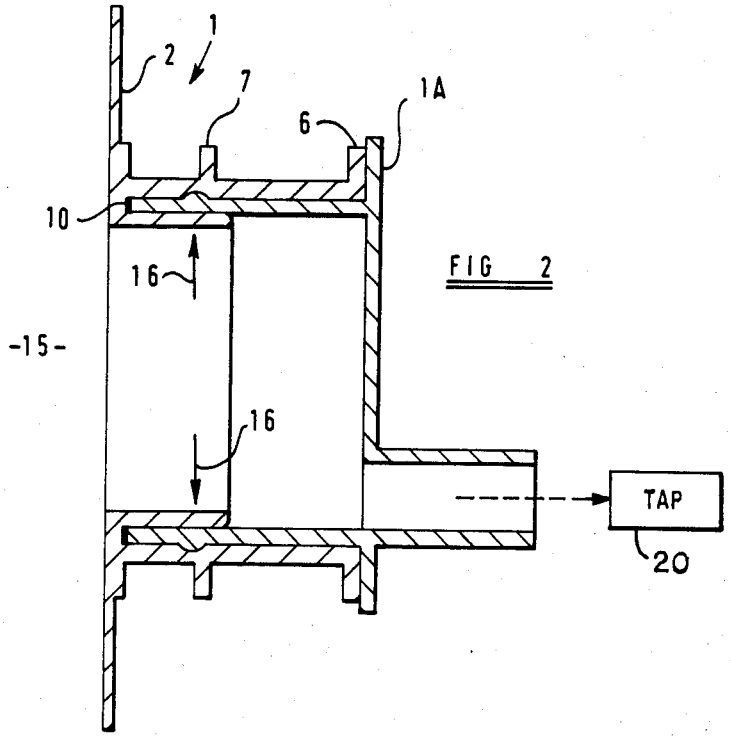
FIG. 2 is a view corresponding to FIG. 1 but showing the connection in an assembled state.

As seen in FIG. 2 the tap part 1*a* has been inserted into the mounting portion 1. The free end of the tubular portion 13 has been received within the annular recess 10 and the rib 14 is received within the annular groove 8 formed in the projection 5. If an excess pressure builds up in the interior of the bag, that is to say at position 15 shown in FIG. 2, pressure will be applied in the direction indicated by the arrows 16 against the inner wall of the inner tubular projection 9, thus forcing this projection 9 firmly into contact with the tubular extension 13 provided on the tap unit 12, and thus, in turn, forcing the rib 14 firmly into the annular recess 8, thus improving the seal defined by the connection and also resisting any axial movement of the tap 2 as a result of the applied pressure.

It can be seen that when the tap unit 2 has been fully inserted into the connector unit 1 the plate 11 formed on the closure 2 abuts against the flange 6 provided on the closure. The flange 7 provided on the closure is provided so that a box or container in which the closure is to be mounted may be received between the flange 7 and the collar 2.

Figure 3:
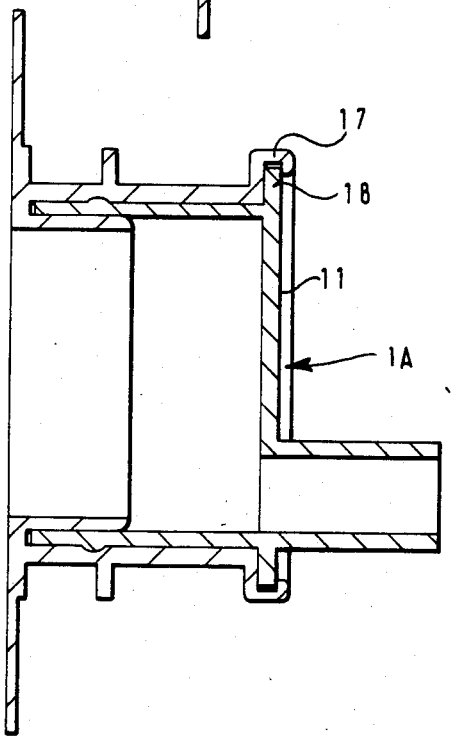
FIG. 3 is a further corresponding cross sectional view showing another embodiment of the invention.

FIG. 3 illustrates a second embodiment of the invention which is very similar to the above-described embodiments save that the end flange 6 on the projection 5 is no longer present, but is replaced by an annular snap fastening portion 17 which can snap fasten on a peripheral extension 18 provided on the end plate 11 of the tap part 1*a*. Thus, in this embodiment of the invention, when the tap part is fully inserted into the sleeve, not only does the rib 14 engage with the annular recess 8, but additionally, by means of the snap or claw action provided by the element 17, the end wall 11 of the tap part 1*a* is firmly grasped and is thus firmly retained in position.

The various components described above may be injection moulded from a suitable plastics material. It is desirable that there is a certain amount of resilience in the inner tubular portion 9 to ensure that when a pressure is exerted on this inner tubular portion the seal defined between the rib 14 and the recess 8 is fluid tight. Many modifications may be made to the invention as described herein. For example, the inner tubular part may have the same length as the outer tubular part or may even have a greater length than the outer tubular part.

What I claim is:

1. A tubular connection, comprising:

an element which includes an inner tubular portion having first and second ends, an outer tubular portion having first and second ends, and means sealingly connecting the first ends of said portions for coaxially mounting said inner portion within said outer portion so that said portions have an annular space between them, said means including an annular collar having a centrally disposed aperture communicating with the interior of said inner portion;

a further element which includes a further tubular portion having first and second ends, the first end of said further portion being disposed within said annular space; and stop means for positioning said further element with respect to said element, said stop means including an outwardly directed first flange affixed to said second end of said outer tubular portion, and an outwardly directed second flange to engage said first flange, said second flange being affixed to said second end of said further tubular portion, wherein said further tubular portion has an annular rib affixed thereto and said outer tubular portion has an annular recess engaging said rib to secure one element to the other, said rib being disposed between said inner and outer tubular portions, with the distance between the first end of said inner portion and said rib being less than the distance between the first and second ends of said inner portion and with the distance between the first end of said inner portion and said recess being less than the distance between the first and second ends of said inner portion.

2. A connector according to claim 1, wherein said collar is connected to a plastic bag adapted to contain a liquid.

3. A connector according to claim 1, wherein said second end of said further tubular portion is connected to a tap.

4. A connector according to claim 1 forming part of a bag containing a carbonated beverage, the connector supporting a tap mounted on said further tubular portion to enable the beverage to be dispensed.

5. A connector according to claim 1, further comprising means affixed to one of said flanges and cooperating with the other of said flanges for snapping said elements together.

6. A connector according to claim 1, wherein said rib is integral with said further portion.

* * * * *